US012661578B2

(12) United States Patent
Williams et al.

(10) Patent No.: US 12,661,578 B2
(45) Date of Patent: Jun. 23, 2026

(54) PLIABLE HANDHELD GAME AND ITS ASSOCIATED METHOD OF MANUFACTURE

(71) Applicant: Plan C, LLC, Bend, OR (US)

(72) Inventors: Kevin Williams, Seabrook, SC (US); Steven Edward Walterscheid, Bend, OR (US)

(73) Assignee: PLAN C, LLC, Bend, OR (US)

( * ) Notice: Subject to any disclaimer, the term of this patent is extended or adjusted under 35 U.S.C. 154(b) by 361 days.

(21) Appl. No.: 18/415,497

(22) Filed: Jan. 17, 2024

(65) Prior Publication Data

US 2024/0245982 A1 Jul. 25, 2024

Related U.S. Application Data

(60) Provisional application No. 63/481,167, filed on Jan. 23, 2023.

(51) Int. Cl.
*A63F 7/04* (2006.01)
*A63F 7/36* (2006.01)

(52) U.S. Cl.
CPC ..... *A63F 7/045* (2013.01); *A63F 7/36* (2013.01); *A63F 2250/0428* (2013.01)

(58) Field of Classification Search
CPC ..... A63F 7/045; A63F 7/36; A63H 23/08
USPC ..... 273/457, 458; 446/180, 197
See application file for complete search history.

(56) References Cited

U.S. PATENT DOCUMENTS 3,535,805 A 10/1970 Peiperl
4,032,141 A 6/1977 Tanimura
4,136,872 A * 1/1979 Matsumoto ..... A63H 23/08 273/357
4,142,715 A 3/1979 Matsumoto
4,362,299 A * 12/1982 Suzuki ..... A63F 7/2409 446/199
4,363,483 A * 12/1982 Minami ..... A63F 7/066 273/457
4,817,311 A 4/1989 Ong S. T.
4,923,429 A 5/1990 Lewis
5,213,540 A 5/1993 Yang
2004/0084845 A1* 5/2004 Lee ..... A63F 9/001 273/340
2005/0012274 A1* 1/2005 Ritter ..... A63H 23/08 446/197
2006/0049066 A1* 3/2006 Wang ..... A45F 3/16 206/217

* cited by examiner

*Primary Examiner* — Thomas M Sember
(74) *Attorney, Agent, or Firm* — LaMorte & Associates PC

(57) ABSTRACT

A game assembly having a fluid pouch with a flexible front panel that is bonded to a rear panel in selected areas. The bonding acts to define an enlarged play area, at least one pump bulb, and at least one fluid passage. The fluid pouch is filled with a liquid medium and game pieces. A housing covers the flexible front panel of the fluid packet leaving at least part of the enlarged play area and at least one pump bulb exposed. Each pump bulb creates a flow jet in the fluid medium when compressed. The flow jet causes the game pieces to move within the liquid medium. The game pieces interact with stationary features to obtain points or to show gameplay skill. The flexible front panel is transparent and is flexible enough to readily deform when manually touched. Accordingly, when touched, the enlarged play area is selectively altered.

19 Claims, 7 Drawing Sheets

PLIABLE HANDHELD GAME AND ITS ASSOCIATED METHOD OF MANUFACTURE

RELATED APPLICATIONS

This application claims the benefit of U.S. Provisional Patent Application No. 63/481,167, filed Jan. 23, 2023.

BACKGROUND OF THE INVENTION

1. Field of the Invention

In general, the present invention relates to handheld games that contain liquid-filled compartments, wherein gameplay includes moving objects through the liquid filled compartments.

2. Prior Art Description

It is a well-known phenomenon that many people are fascinated with watching objects move about inside a liquid-filled container. It is for this reason that products, such as snow globes, are so popular. In a snow globe and similar products, the movement of objects is created by shaking the globe and disrupting objects in the globe that are slightly heavier than the water. The effect is short-lived. As such, the fascination of watching a snow globe often fade quickly.

Toy manufacturers recognized the fascination of watching objects move in liquid-filled containers and have designed toys and games that benefit from the phenomenon. Toys and games have been developed where the play involves propelling objects through a liquid-filled container using jets of water, waves, bubbles, and/or the stirring of the water. The play of the game perpetuates the movement within the liquid-filled container, therein providing a visually interesting item for as long as the game is played. Such water-filled games and amusement devices are exemplified by U.S. Pat. No. 3,535,805, to Peiperl, U.S. Pat. No. 4,032,141, to Tanimura, U.S. Pat. No. 4,142,715, to Matsumoto, U.S. Pat. No. 4,817,311 to Ong S. T., U.S. Pat. No. 4,923,429, to Lewis, and U.S. Pat. No. 5,213,540, to Yang.

In all the prior art attempts to create a game or toy using a water-filled container, the container used to retain the water and move the objects is rigid. As such, in order to make the toy portable, a small container must be used. The smaller the container, the less area within the container can be viewed and the lesser the visual interest and play value is provided by the toy. Furthermore, regardless of size, prior art containers are rigid and heavy for their size. As such, it is difficult to carry a pitot art water-filled container toy in a pocket or backpack.

A need therefore exists for an improved water-filled container toy that is flexible, has a large play field yet is lightweight for its size. This need is met by the present invention as described and claimed below.

SUMMARY OF THE INVENTION

The present invention is a handheld, fluid-filled game assembly. The game assembly has a fluid pouch with a flexible front panel that is bonded to a rear panel in selected areas. The bonding acts to define an enlarged play area, at least one pump bulb, and at least one fluid passage that joins the enlarged play area to at least one pump bulb. The fluid pouch is filled with a liquid medium and game pieces that move freely through the liquid medium.

A housing covers the flexible front panel of the fluid packet leaving at least part of the enlarged play area and at least one pump bulb exposed. Each pump bulb creates a flow jet in the fluid medium when the pump bulb is compressed. The flow jet causes the game pieces to move within the liquid medium. The game pieces interact with stationary features to obtain points or to show gameplay skill. The flexible front panel of the enlarged play area is transparent and is flexible enough to readily deform when manually touched. Accordingly, when touched, the enlarged play area is selectively altered. This can change the movement of the liquid medium and the game pieces within the enlarged play area.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention game assembly can be embodied in many ways, only a few exemplary embodiments are illustrated. The exemplary embodiments are being shown for the purposes of explanation and description. The exemplary embodiments are selected in order to set forth some of the best modes contemplated for the invention. The illustrated embodiments, however, are merely exemplary and should not be considered limitations when interpreting the scope of the appended claims.

Figure 1:
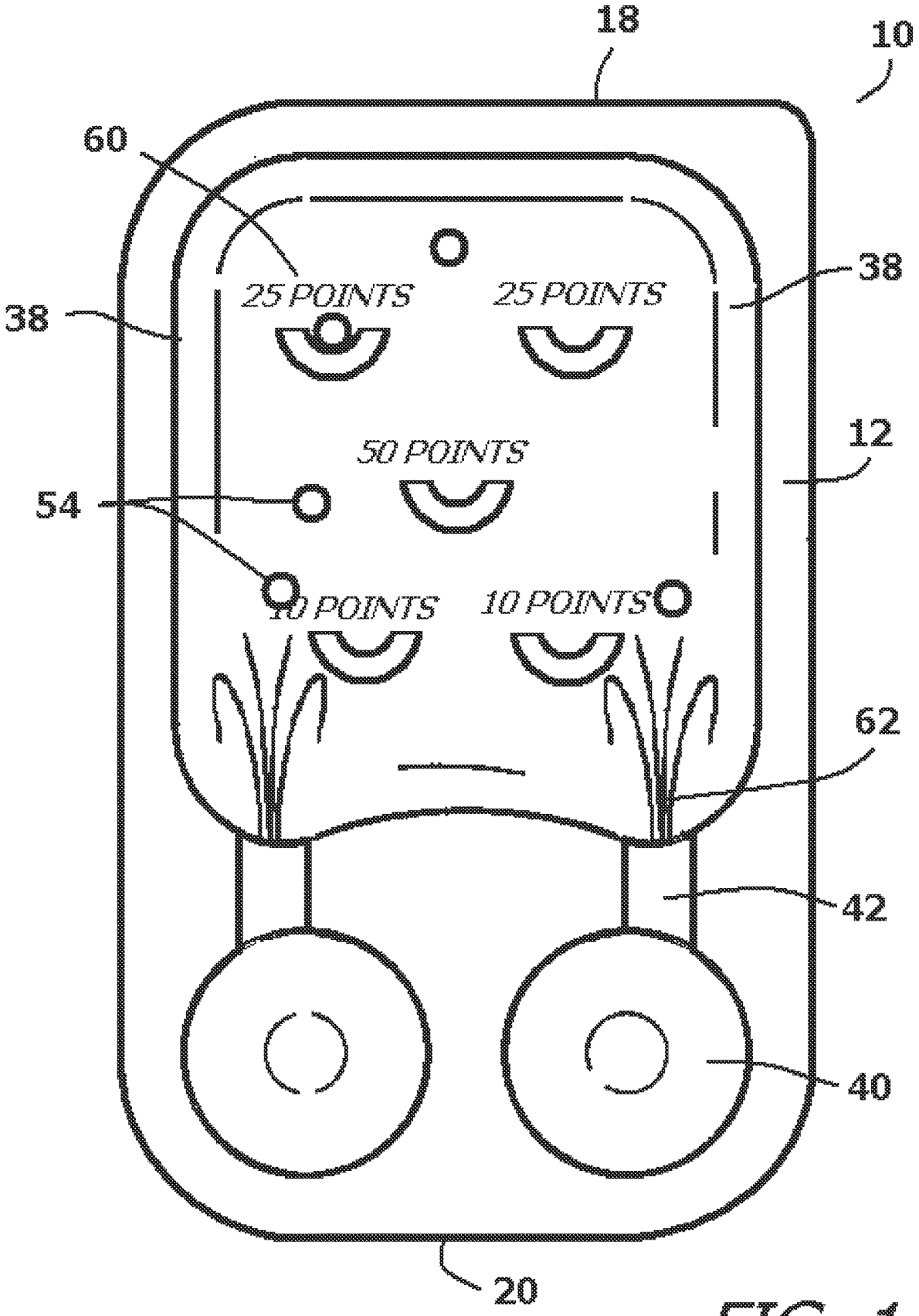
FIG. 1 shows an exemplary embodiment of a handheld game assembly.
Figure 2:
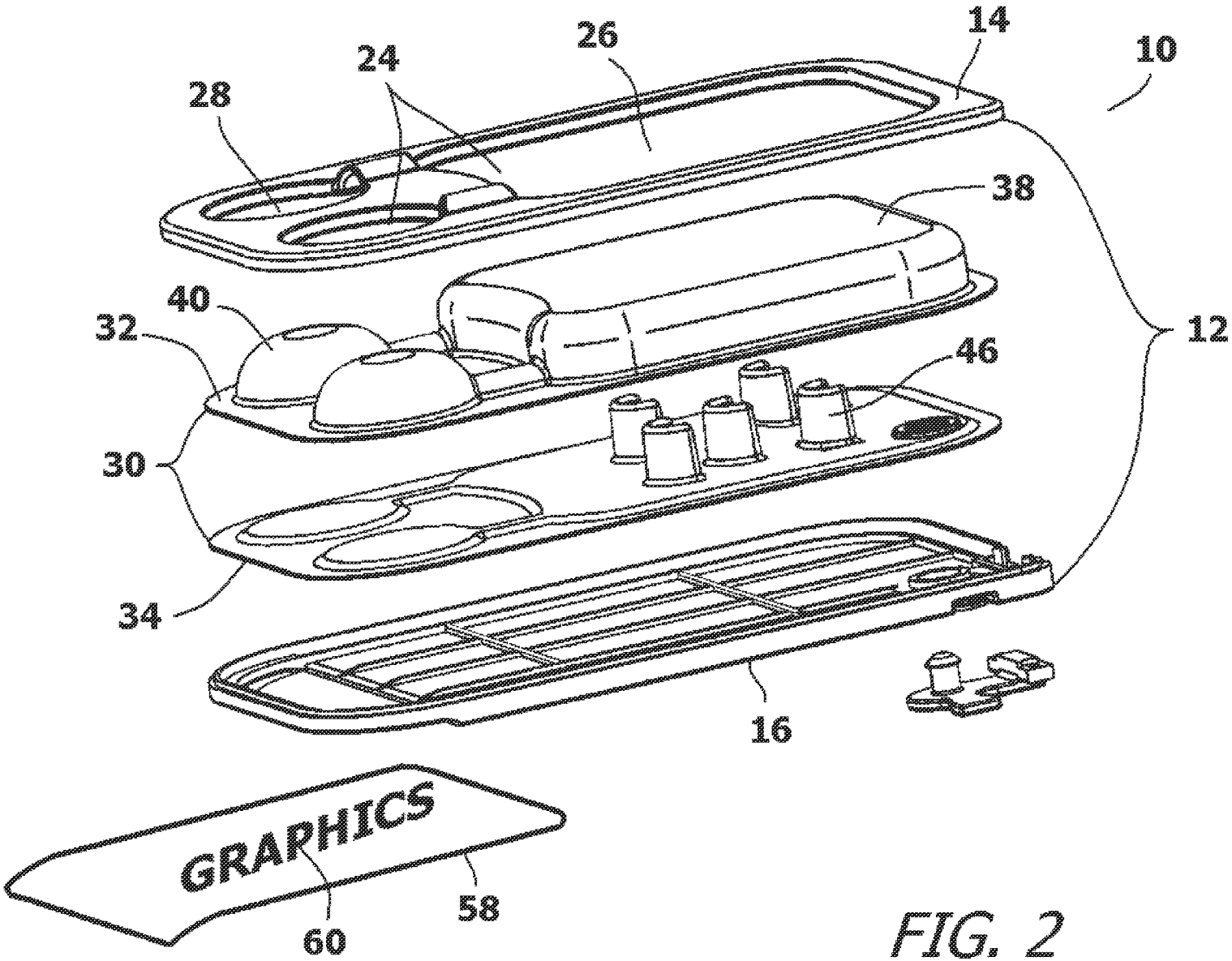
FIG. 2 shows an exploded view of the exemplary embodiment of FIG. 1.
Figure 3:
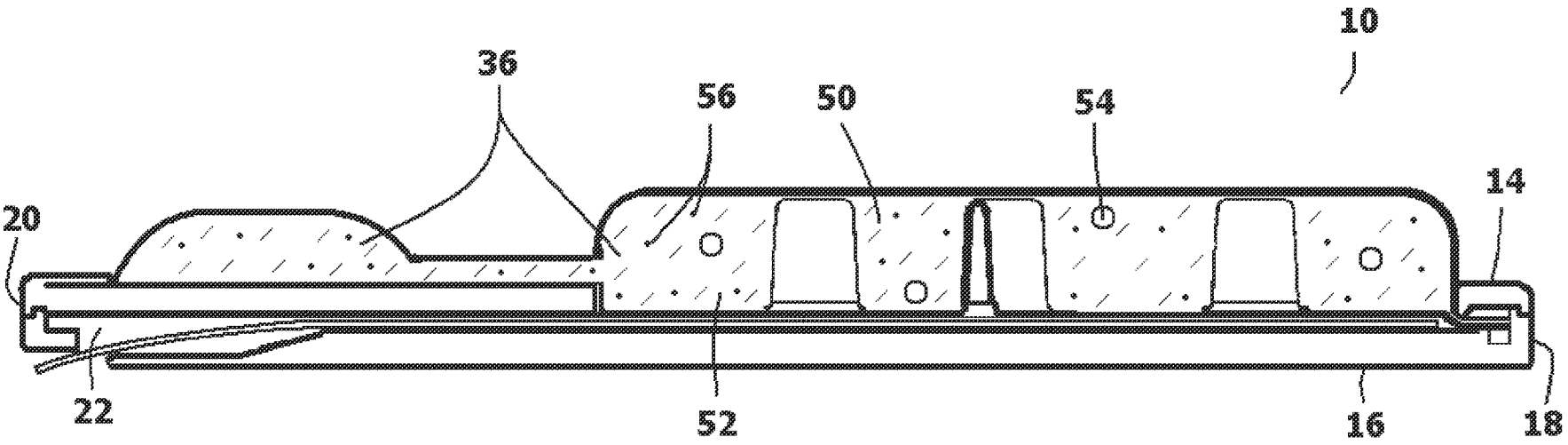
FIG. 3 shows a cross-section of the exemplary embodiment of FIG. 1.

Referring to FIG. 1, FIG. 2, and FIG. 3, a handheld game assembly 10 is shown. The handheld game assembly 10 is thin, having a thickness that is much less than its length and height. This enables the handheld game assembly 10 to both fit comfortably in a player's hands and in a player's pocket. The handheld game assembly 10 contains a housing 12 that is held in a player's hands when played. The housing 12 is molded from a thin, hard plastic. The housing 12 has a front surface 14, a rear surface 16, a top edge 18, and a bottom edge 20. There is an internal open area 22 defined by the housing 12 between the front surface 14 and the rear surface 16.

The front surface 14 defines a plurality of window openings 24 that provide access to the internal open area 22 within the housing 12. The window openings 24 include a large display opening 26 and one or more smaller control openings 28.

A fluid pouch 30 is provided. The fluid pouch 30 has a front panel 32 and a rear panel 34 that are sealed together in a pattern to form various liquid filled compartments 36. Both the front panel 32 and the rear panel 34 are made from sheets of flexible transparent plastic. The rear panel 34 can be generally flat. However, the front panel 32 is contoured to create the various liquid filled compartments 36. The liquid filled compartments 36 include an enlarged play area 38, pump bulbs 40, and fluid passages 42 that lead between the enlarged play area 38 and the pump bulbs 40. The front panel 32 is bonded to the rear panel 34 in selected areas to ensure that fill mixture 50 is trapped in the liquid filled compartments 36 and can only flow into and between the enlarged play area 38 and the pump bulbs 40.

The fluid pouch 30 is positioned within the internal open area 22 defined by the housing 12. The front panel 14 of the fluid pouch 30 abuts against the front of the housing 12 and is preferably adhesively bonded in this position. The fluid pouch 30 is shaped so that the enlarged play area 38 of the fluid pouch 30 passes into the large display opening 26 on the front surface 14 of the housing 12. Likewise, the pump bulbs 40 pass into the smaller control openings 28 on the front surface 14 of the housing 12. In this manner, both the enlarged play area 38 and the pump bulbs 40 of the fluid pouch 30 can be manually touched and deformed while the fluid pouch 30 is within the plastic housing 12.

Game features 46 are mounted to the rear panel 34 of the fluid pouch 30 inside the enlarged play area 38. Since the fluid pouch 30 is transparent, the game features 46 can be seen through the display opening 26 in the front surface 14 of the housing 12. The game features 46 can be goals, platforms, rings, posts, hooks, tubes, and the like. The theme of the game features 46 will match the theme of the overall game assembly 10. Thus, if the theme of the handheld game assembly is basketball, the game features 46 can be basketball hoops and/or basketball players. If the theme of the overall handheld game assembly 10 is pirate related, the game features can be ships, treasure chests and swords.

A fill mixture 50 is used to fill the liquid filled compartments 36 in the fluid pouch 30. The fill mixture 50 includes a liquid medium 52 mixed with free game pieces 54 and optional decorative elements 56. The liquid medium 52 can be water, saline, or a non-toxic oil, such as vegetable oil. The free game pieces 54 are shown as balls. However, the free game pieces 54 can have any shape, such as rings, fish, or aliens. The free game pieces 54 are small enough to enable the free game pieces 54 to move freely within the liquid filled compartments 36. However, the free game pieces 54 are preferably too large to pass into the fluid passages 42 or the pump bulbs 40. The free game pieces 54 are preferably brightly colored so that they can be readily seen as they move through the enlarged play area 38. The decorative elements 56 are for aesthetics and can be small enough to pass into the pump bulbs 40. The decorative elements 56 can be brightly colored glitter or flakes that are highly visible.

Both the front panel 32 and the rear panel 34 of the fluid pouch 30 are transparent. A game card 58 is provided that can be selectively inserted into the housing 12 though the bottom edge 20 behind the fluid pouch 30. The game card 58 contains graphics 60 that can be seen through the fluid pouch 30. The graphics 60 are positioned near the game features 46 and are used to identify the game features 46 by type or value. The game card 58 can also provide theme graphics that make the overall game play more aesthetically pleasing. In the shown embodiment, the game card 58 provides a score value to each of the game features 46. The score values can be changed by removing and replacing the game card 58 with an alternate game card.

The handheld game assembly 10 is played by moving free game pieces 54 onto, through, or around the game features 46 within the liquid filled compartment 36. As mentioned, the game features 46 can be any structure that is of interest and can interact with the free game pieces 54. The free game pieces 54 are moved by creating flow jets 62 of the liquid medium 52 utilized within the liquid filled compartment 36. The flow jets 62 are created by selectively squeezing the pump bulbs 40 that are coupled to the liquid filled chamber 12. The fluid passages 42 interconnect the pump bulbs 40 to the enlarged play area 38. When a pump bulb 22 is pressed, the liquid medium 52 is displaced through a fluid passage 42 and into the enlarged play area 38, forming a flow jet 62. Each fluid passage 42 acts as a nozzle that concentrates the displaced liquid medium 52 into the flow jet 62. The flow jets 62 then move the free game pieces 54 within the enlarged play area 38. The pump bulbs 40 are selectively pressed and released to control the flow jets 62. The flow jets 62 are controlled to make the free game pieces 54 move and interact with the game features 46.

The game features 46 and the moving free game pieces 54 are contained within the fluid pouch 30 and are viewed through the enlarged play area 38. The front panel 32 of the fluid pouch 30 is transparent and highly flexible. As such, the enlarged play area 38 containing the game features 46 can be selectively deformed by physically pressing a finger against the front panel 32 in the enlarged play area 38. If the enlarged play area 38 is deformed, the effects of the flow jet 62 change. Likewise, the ability of the free game pieces 54 to move in the enlarged play area 38 changes. As such, the play of the game can be altered by touching the enlarged play area 38. The enlarged play area 38, therefore, acts as a dynamic control pad that can be contacted by a player and used to control the movements of the free game pieces 54 and the directional flow of the flow jets 62. The ability to deform the enlarged play area 38 also enables players to dislodge free game pieces 54 that become stuck, tangled, or entrapped within the enlarged play area 38.

Figure 4:
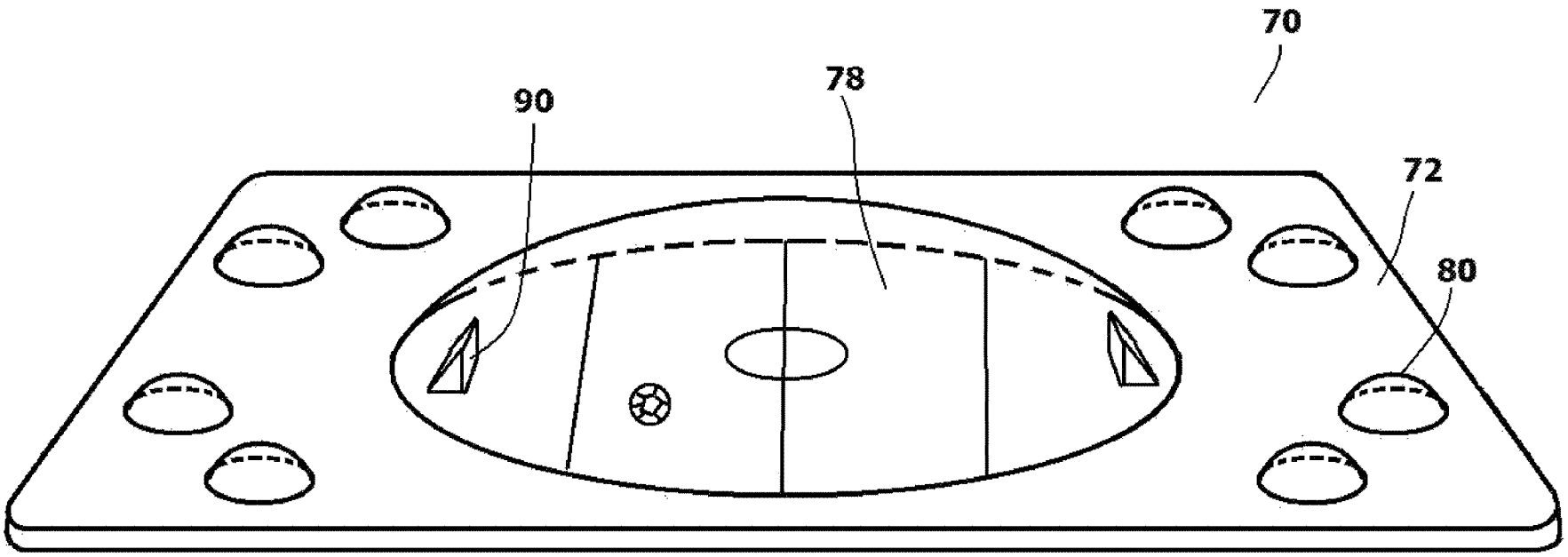
FIG. 4 shows an alternate embodiment of the present invention game assembly.
Figure 5:
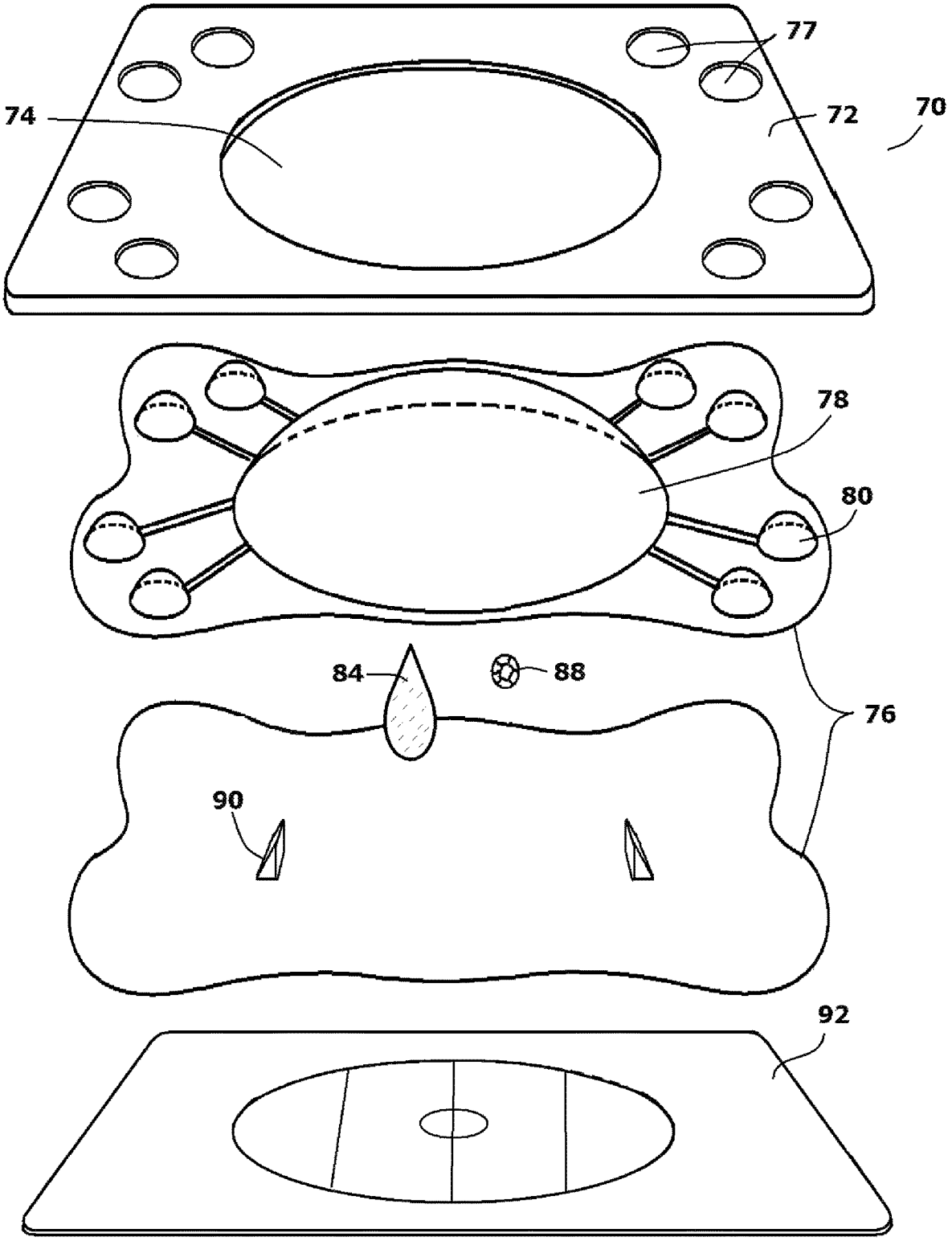
FIG. 5 shows an exploded view of the alternate embodiment of FIG. 4.

Referring to FIG. 4 and FIG. 5, an alternate embodiment of a handheld game assembly 70 is shown. In this embodiment, the handheld game assembly 70 can be played with two hands of one player or can be set on a surface and played by two players. The handheld game assembly 70 has a housing 72 that defines a central display opening 74. Control openings 77 are formed in the housing 72 on opposite sides of the central display opening 74 in a mirrored pattern.

A fluid pouch 76 is provided. The fluid pouch 76 has an enlarged play area 78 that passes into the central display opening 74 of the housing 72. Similarly, the fluid pouch 76 also has pump bulbs 80 that pass into the control openings 77 of the housing 72. The fluid pouch 76 has fluid passages 82 that connect the pump bulbs 80 to the enlarged play area 78.

The fluid pouch 76 is made from transparent, flexible material. The fluid pouch 76 is filled with a fill mixture 84 that contains a liquid medium 86 and one or more free game pieces 88. The fluid pouch 76 also contains game features 90, such as hoops or goals, that are utilized during the course of play.

A game card 92 is provided under the fluid pouch 76. The game card 92 contains graphics that can be seen through the fluid pouch 76. The game card 92 can be removable or can be affixed to the bottom of the fluid pouch 76.

During play, the pump bulbs 80 are depressed to create flow jets 94 in the enlarged play area 78. The flow jets 94 move the free game pieces 88 and cause the free game pieces 88 to interact with the game features 90. The fluid pouch 76 is made of flexible plastic. As such, a player can also press and deform the enlarged play area 78. This affects the flow jets, and the movement of game pieces 88 within the enlarged play area 78.

Figure 6:
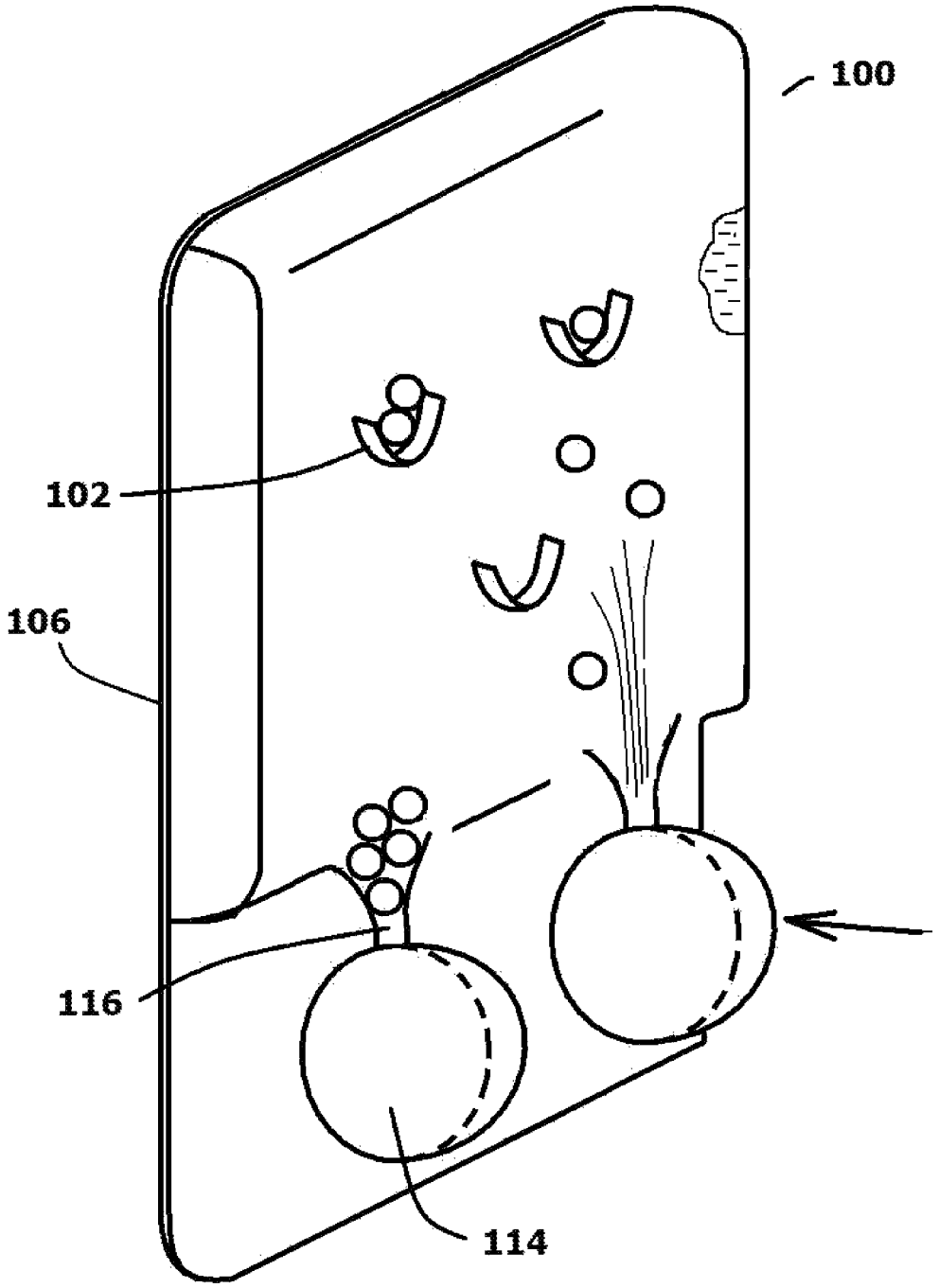
FIG. 6 shows a second alternate embodiment of the present invention game assembly.
Figure 7:
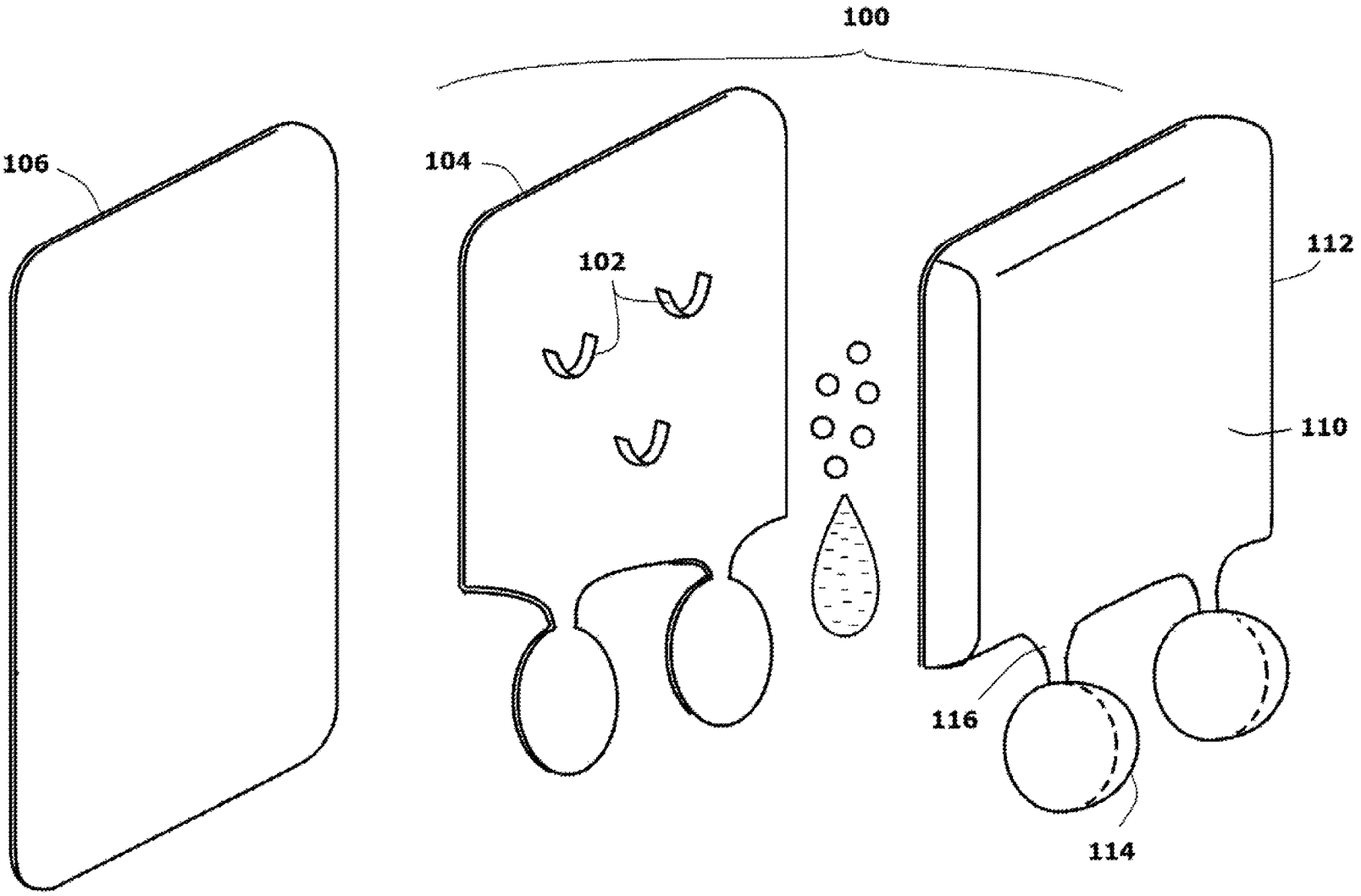
FIG. 7 shows an exploded view of the second alternate embodiment of FIG. 6.

Referring now to FIG. 6 and FIG. 7, another embodiment of a handheld game assembly 100 is shown wherein the entire handheld game assembly 100 is flexible and malleable. The game features 102 are all attached to a flexible support panel 104. The flexible support panel 104 and the game features 102 are made from silicone, thermoplastic rubber, or a similar elastomeric material. The flexible support panel 104 is placed against a back sheet 106. The back sheet 106 is bonded to a contoured panel 110. The contoured panel 110 is vacuum molded into the combined configuration of an enlarged play area 112, pump bulbs 114 and fluid passages 116. The back sheet 106 and the contoured panel 110 are both made from transparent flexible plastic. The flexible support panel 104 along with a liquid medium 118, and free game pieces 120 are trapped between the back sheet 106 and the contoured panel 110. The support panel 104 maintains the desired shape of the handheld game assembly 100 and prevents the back sheet 106 and the contoured panel 110 from sagging out of shape in the user's hands.

The contoured panel 110 is transparent so that the contents of the handheld game assembly 100 can be viewed. The support panel 104 can be transparent but is preferably opaque to provide visual contrast.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A game assembly comprising:

a fluid pouch having a flexible front panel bonded to a rear panel in selected areas to define an enlarged play area, at least one pump bulb, and at least one fluid passage that joins said enlarged play area to said at least one pump bulb, wherein said fluid pouch is filled with a liquid medium and game pieces that move freely through said liquid medium;

a housing that covers said flexible front panel of said fluid packet leaving at least part of said enlarged play area and said at least one pump bulb exposed;

wherein said at least one pump bulb creates a flow jet in said liquid medium when compressed that causes said game pieces to move within said liquid medium; and wherein said flexible front panel is flexible enough to readily deform when manually touched, therein selectively altering said enlarged play area and movement of said liquid medium and said game pieces within said enlarged play area.

2. The game assembly according to claim 1, further including stationary game features that are disposed within said enlarged play area.

3. The game assembly according to claim 2, wherein said flexible front panel and said rear panel are transparent.

4. The game assembly according to claim 3, further including a game card with graphics that is positioned against said rear panel, wherein said graphics are visible through said flexible front panel and said rear panel through said enlarged play area.

5. The game assembly according to claim 4, wherein said housing retains said card in position against said rear panel.

6. The game assembly according to claim 5, wherein said game card is selectively removable and replaceable in said housing.

7. The game assembly according to claim 3 wherein said graphics on said game card provide point values to at least some of said stationary game features.

8. A game assembly comprising:

a rear panel that is transparent;

a flexible front panel bonded to said rear panel in selected areas to define an enlarged play area, at least one pump bulb, and at least one fluid passage that joins said enlarged play area to said at least one pump bulb, wherein said flexible front panel is transparent;

a fill mixture containing a liquid medium and game pieces filling said enlarged play area, said at least one pump bulb, and said at least one fluid passage, wherein said at least one pump bulb creates a flow jet in said liquid medium when compressed that causes said game pieces to move within said liquid medium; and wherein said flexible front panel is flexible enough to readily deform when manually touched, therein enabling said enlarged play area to be manually deformed to a degree where movement of said liquid medium and said game pieces within said enlarged play area is affected.

9. The game assembly according to claim 8, wherein said rear panel is flexible.

10. The game assembly according to claim 8, further including a housing that covers said flexible front panel leaving at least part of said enlarged play area and said at least one pump bulb exposed.

11. The game assembly according to claim 8, further including stationary game features that are disposed within said enlarged play area.

12. The game assembly according to claim 11, wherein said stationary game features are affixed to said rear panel.

13. The game assembly according to claim 11, further including a game card with graphics that is positioned against said rear panel, wherein said graphics are visible through said flexible front panel and said rear panel through said enlarged play area.

14. The game assembly according to claim 13, wherein said game card is selectively removable and replaceable.

15. The game assembly according to claim 13 wherein said graphics on said game card assign point values to at least some of said stationary game features.

16. A game assembly comprising:

an enlarged play area containing game features, wherein said enlarged play area is filled with a liquid medium and game pieces that move freely in said liquid medium;

manual pumps that create flow jets in said enlarged play area, therein moving said game pieces within said enlarged play area;

wherein said enlarged play area has a transparent front panel that is flexible and deformable by being touched, wherein deformation of said transparent front panel effects movement of said game pieces within said enlarged play area.

17. The game assembly according to claim 16, further including a housing that covers said front panel leaving at least part of said enlarged play area exposed.

18. The game assembly according to claim 16, further including stationary game features that are disposed within said enlarged play area.

19. The game assembly according to claim 16, further including a game card with graphics that is positioned against said rear panel, wherein said graphics are visible through said flexible front panel and said rear panel through said enlarged play area.

* * * * *